United States Patent [19]

Liston

[11] Patent Number: 4,629,578

[45] Date of Patent: Dec. 16, 1986

[54] SUCCINIMIDE COMPLEXES OF BORATED ALKYL CATECHOLS AND LUBRICATING OIL COMPOSITIONS CONTAINING SAME

[75] Inventor: Thomas V. Liston, San Rafael, Calif.

[73] Assignee: Chevron Research Company, San Francisco, Calif.

[21] Appl. No.: 745,565

[22] Filed: Jun. 17, 1985

[51] Int. Cl.[4] ..... C10M 129/26

[52] U.S. Cl. ..... 252/32.7 E; 252/49.6; 252/42.7; 252/33.4; 252/51; 548/405; 558/294; 558/291

[58] Field of Search ..... 252/32.7 E, 49.6, 33.4, 252/51, 42.7, 400.41; 548/405; 260/462 R

[56] References Cited

U.S. PATENT DOCUMENTS

| | | | |
|---|---|---|---|
| 2,795,548 | 6/1957 | Thomas et al. | 252/49.6 |
| 2,962,442 | 11/1960 | Andress, Jr. | 252/515 R |
| 3,361,672 | 1/1968 | Andress et al. | 252/49.6 |
| 3,445,498 | 5/1969 | Cyba | 252/49.6 |
| 3,703,536 | 11/1972 | Piasek et al. | 252/51 |
| 4,034,038 | 7/1977 | Vogel | 252/49.6 |
| 4,301,019 | 11/1981 | Horodysky | 252/49.6 |
| 4,375,418 | 3/1983 | Zoleski et al. | 252/32.7 E |
| 4,394,277 | 7/1983 | Small, Jr. | 252/49.6 |
| 4,455,243 | 6/1984 | Liston | 252/32.7 |
| 4,474,670 | 10/1984 | Braid et al. | 252/32.7 E |
| 4,495,088 | 1/1985 | Liston | 252/32.7 |
| 4,563,293 | 1/1986 | Small, Jr. | 252/32.7 |

FOREIGN PATENT DOCUMENTS

| | | | |
|---|---|---|---|
| 0125032 | 11/1984 | European Pat. Off. | 252/49.6 |
| 2102023 | 1/1983 | United Kingdom | 252/32.7 E |

*Primary Examiner*—William R. Dixon, Jr.
*Assistant Examiner*—Margaret B. Medley
*Attorney, Agent, or Firm*—S. R. LaPaglia; R. C. Gaffney; G. F. Swiss

[57] ABSTRACT

Lubricating oils containing borated alkyl catechols-succinimide complex are effective in reducing fuel consumption in an internal combustion engine.

10 Claims, No Drawings

SUCCINIMIDE COMPLEXES OF BORATED ALKYL CATECHOLS AND LUBRICATING OIL COMPOSITIONS CONTAINING SAME

BACKGROUND OF THE INVENTION

1. Field of the Invention

The invention is concerned with the product obtained by reacting a borated alkyl catechol with a succinimide and the use of said product in lubricant compositions.

2. Description of the Prior Art

With the crisis associated with diminishing amounts of fossil fuel and the rapidly increasing prices for this fuel, there has been a great deal of interest in reducing the amount of fuel consumed by automobile engines, and the like.

Thus, there is a great need to find lubricants that reduce the overall friction in the engine, thus reducing the energy requirements thereto.

U.S. Pat. No. 2,795,548 discloses the use of lubricating oils compositions containing borated alkyl catechols. The oil compositions are used in the crankcase of an internal combustion engine in order to reduce oxidation of the oil and corrosion of the metal parts of the engine.

There is a problem with the use of borated alkyl catechols in lubricatinq oils since they are sensitive to moisture and hydrolyze readily. The hydrolysis leads to haze and/or precipitate formation which must be filtered out prior to use.

It has now been found that the borated alkyl catechols may be stabilized against hydrolysis by complexing the borated alkyl catechol with an alkenyl or alkyl mono or bis succinimide.

Most importantly, it has now been found that lubricating the crankcase of an internal combustion engine with a lubricating oil containing the reaction product of a borated alkyl catechol and a succinimide reduces the fuel consumption of the engine.

SUMMARY OF THE INVENTION

According to the present invention, lubricating oils are provided which reduce friction between sliding metal surfaces and which are especially useful in the crankcase of internal combustion engines. The reduced friction results from the addition to the lubricating oil of small amounts of a complex prepared by reacting a borated alkyl catechol and an alkyl or alkenyl mono or bis succinimide.

Thus, in one aspect, this invention relates to a lubricating oil composition comprising an oil of lubricating viscosity and an effective amount to reduce friction of a complex prepared by reacting (a) a borated alkyl catechol and (b) an oil soluble alkyl or alkenyl mono or bis succinimide.

Other additives may also be present in the lubricating oil in order to obtain a proper balance of properties such as dispersancy, corrosion, wear and oxidation inhibition which are critical for the proper operation of an internal combustion engine.

In still another aspect of this invention, there is provided a method for reducing fuel consumption of an internal combustion engine by treating the moving surfaces thereof with the lubricating oil composition described above. Specifically, improvements in fuel mileage of from 1% to 2% may be obtained by employing the composition of this invention. This fuel economy improvement can be obtained in both compression-ignition engines, that is, diesel engines, and spark-ignition engines, that is, gasoline engines.

Moreover, lubricating oil compositions containing the borated alkyl catechol-succinimide complex of this invention have been found additionally to possess antioxidant properties and when employed in diesel engines they possess diesel deposit inhibition.

DETAILED DESCRIPTION OF THE INVENTION

The borated alkyl catechols are prepared by borating a alkyl catechol with boric acid with removal of the water of reaction. Preferably, there is sufficient boron present such that each boron will react with from 1.5 to 2.5 hydroxyl groups present in the reaction mixture.

The reaction may be carried out at a temperature in the range of 60° C. to 135° C., in the absence or presence of any suitable organic solvent such as methanol, benzene, xylenes, toluene, neutral oil and the like.

The alkyl catechols or mixtures thereof which may be used to prepare the borated alkyl catechols used in this invention are preferably monoalkyl catechols of Formula I

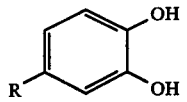

I wherein R is alkyl containing 10 to 30 carbon atoms and preferably from 16 to 26 carbon atoms. Also, up to 25% by weight but preferably less than 10% by weight of the monoalkyl catechols may have the R group in a position adjacent or Ortho to one of the hydroxy groups and has the Formula II

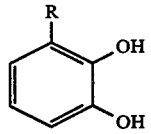

II wherein R is defined above.

Also included among alkyl catechols which may be used to prepare the borated alkyl catechols of this invention are dialkyl catechols which are generally of Formula III

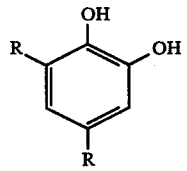

III wherein R is defined above. Trialkyl catechols may also be employed although they are not preferred.

Among the alkyl catechols which may be employed are decyl catechol, undecyl catechol, dodecyl catechol, tetradecyl catechol, pentadecyl catechol, hexadecyl catechol, octadecyl catechol, eicosyl catechol, hexacosyl catechol, triacontyl catechol, and the like. Also, a mixture of alkyl catechols may be employed such as a mixture of $C_{14}$–$C_{18}$ alkyl catechols or a mixture of $C_{16}$–$C_{26}$ alkyl catechol may be used.

The alkyl catechols of the Formula III may be prepared by reacting a $C_{10}$ to $C_{30}$ olefin such as a branched olefin or straight-chained alpha-olefin containing 10 to 30 carbon atoms with pyrocatechol in the presence of a sulfonic acid catalyst at a temperature of from about 60° C. to 200° C., and preferably 125° C. to 180° C. in an essentially inert solvent at atmospheric pressure. Examples of the inert solvents include benzene, toluene, chlorobenzene and 250 Thinner which is a mixture of aromatics, paraffins and naphthenes.

The term "branched olefin" means that branching occurs at the double bond. The term "straight chain alpha olefin" means that the alpha olefin contains little (less than 10%) or no branching at the double bond or elsewhere.

A product which is predominantly monoalkyl catechol may be prepared by using molar ratios of reactants and preferably a 10% by weight molar excess of branched olefin or alpha-olefin over catechol is used. When used at molar ratios, the resulting products are generally monoalkyl catechols but contain some amounts of dialkyl catechol. In any event, molar excess of pyrocatechol (i.e., 2 equivalents of pyrocatechol for each equivalent of olefin) can be used in order to enhance monoalkylation if predominantly monoalkyl catechol is desired. Predominantly dialkyl catechols may be prepared by employing two equivalents to pyrocatechol of the same or different olefin.

Use of a branched olefin results in a greater proportion of alkyl catechols of Formula I than use of straight-chain alpha-olefins. Use of such branched olefins generally results in greater than 90% alkyl catechol of Formula I and less than 10% alkyl catechol of Formula II.

The borated alkyl catechols are stabilized against hydrolysis by reacting the catechols with an alkyl or alkenyl mono or bis succinimide. In the preferred embodiment, an alkyl or alkenyl mono-succinimide is employed.

The oil soluble alkenyl or alkyl mono- or bis-succinimides which are employed in this invention are generally known as lubricating oil detergents and are described in U.S. Pat. Nos. 2,992,708, 3,018,291, 3,024,237, 3,100,673, 3,219,666, 3,172,892 and 3,272,746, the disclosures of which are incorporated by reference. The alkenyl succinimides are the reaction product of a polyolefin polymer-substituted succinic anhydride with an amine, preferably a polyalkylene polyamine. The polyolefin polymer-substituted succinic anhydrides are obtained by reaction of a polyolefin polymer or a derivative thereof with maleic anhydride. The succinic anhydride thus obtained is reacted with the amine compound. The preparation of the alkenyl succinimides has been described many times in the art. See, for example, U.S. Pat. Nos. 3,390,082, 3,219,666 and 3,172,892, the disclosure of which are incorporated herein by reference. Reduction of the alkenyl substituted succinic anhydride yields the corresponding alkyl derivative. A product comprising predominantly mono- or bis-succinimide can be prepared by controlling the molar ratios of the reactants. Thus, for example, if one mole of amine is reacted with one mole of the alkenyl or alkyl substituted succinic anhydride, a predominantly mono-succinimide product will be prepared. If two moles of the succinic anhydride are reacted per mole of polyamine, a bis-succinimide will be prepared.

Particularly good results are obtained with the lubricating oil compositions of this invention when the alkenyl succinimide is a mono-succinimide prepared from a polyisobutene-substituted succinic anhydride of a polyalkylene polyamine.

The polyisobutene from which the polyisobutene-substituted succinic anhydride is obtained by polymerizing isobutene and can vary widely in its compositions. The average number of carbon atoms can range from 30 or less to 250 or more, with a resulting number average molecular weight of about 400 or less to 3,000 or more. Preferably, the average number of carbon atoms per polyisobutene molecule will range from about 50 to about 100 with the polyisobutenes having a number average molecular weight of about 600 to about 1,500. More preferably, the average number of carbon atoms per polyisobutene molecule ranges from about 60 to about 90, and the number average molecular weight ranges from about 800 to 1,300. The polyisobutene is reacted with maleic anhydride according to well-known procedures to yield the polyisobutene-substituted succinic anhydride. See, for example, U.S. Pat. Nos. 4,388,471 and 4,450,281.

In preparing the alkenyl succinimide, the substituted succinic anhydride is reacted with a polyalkylene polyamine to yield the corresponding succinimide. Each alkylene radical of the polyalkylene polyamine usually has up to about 8 carbon atoms. The number of alkylene radicals can range up to about 8. The alkylene radical is exemplified by ethylene, propylene, butylene, trimethylene, tetramethylene, pentamethylene, hexamethylene, octamethylene, etc. The number of amino groups generally, but not necessarily, is one greater than the number of alkylene radicals present in the amine, i.e., if a polyalkylene polyamine contains 3 alkylene radicals, it will usually contain 4 amino radicals. The number of amino radicals can range up to about 9. Preferably, the alkylene radical contains from about 2 to about 4 carbon atoms and all amine groups are primary or secondary. In this case, the number of amine groups exceeds the number of alkylene groups by 1. Preferably the polyalkylene polyamine contains from 3 to 5 amine groups. Specific examples of the polyalkylene polyamines include ethylenediamine, diethylenetriamine, triethylenetetramine, propylenediamine, tripropylenetetramine, tetraethylenepentamine, trimethylenediamine, pentaethylenehexamine, di-(trimethylene)triamine, tri(hexamethylene)tetramine, etc.

Other amines suitable for preparing the alkenyl succinimide useful in this invention include the cyclic amines such as piperazine, morpholine and dipiperazines.

Preferably the alkenyl succinimides used in the compositions of this invention have the following formula:

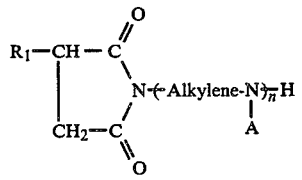

I wherein:

a. $R_1$ represents an alkenyl group, preferably a substantially saturated hydrocarbon prepared by polymerizing aliphatic monoolefins. Preferably $R_1$ is prepared from isobutene and has an average number of carbon atoms and a number average molecular weight as described above;

b. the "Alkylene" radical represents a substantially hydrocarbyl group containing up to about 8 carbon atoms and preferably containing from about 2–4 carbon atoms as described hereinabove;

c. A represents a hydrocarbyl group, an amine-substituted hydrocarbyl group, or hydrogen. The hydrocarbyl group and the amine-substituted hydrocarbyl groups are generally the alkyl and amino-substituted alkyl analogs of the alkylene radicals described above. Preferably A represents hydrogen;

d. n represents an integer of from about 1 to 10, and preferably from about 3–5.

The alkenyl succinimide is present in the lubricating oil compositions of the invention in an amount effective to stabilize the borated alkyl catechols against hydrolysis and to act as a dispersant and prevent the deposit of contaminants formed in the oil during operation of the engine.

The exact structure of the complex of this invention is not known for certain. However, while not limiting this invention to any theory, it is believed to be compounds in which boron is either complexed, by or the salt of, one or more nitrogen atoms of the basic nitrogen contained in the succinimide. Therefore, it is preferred that the alkenyl succinimide contain at least 2 and preferably 3–5 basic nitrogens per atoms.

The complex may be formed by reacting the borated alkyl catechol and the succinimide together neat at a temperature above the melting point of the mixture of reactants and below the decomposition temperature, or in a diluent in which both reactants are soluble. For example, the reactants may be combined in the proper ratio in the absence of a solvent to form a homogeneous product which may be added to the oil or the reactants may be combined in the proper ratio in a solvent such as toluene or chloroform, the solvent stripped off, and the complex thus formed may be added to the oil. Alternatively, the complex may be prepared in a lubricating oil as a concentrate containing from about 20 to 90% by weight of the complex, which concentrate may be added in appropriate amounts to the lubricating oil in which it is to be used or the complex may be prepared directly in the lubricating oil in which it is to be used.

The diluent is preferably inert to the reactants and products formed and is used in an amount sufficient to insure solubility of the reactants and to enable the mixture to be efficiently stirred.

Temperatures for preparing the complex may be in the range of from 25° C. to 200° C. and preferably 25° C. to 100° C. depending on whether the complex is prepared neat or in a diluent, i.e., lower temperatures may be used when a solvent is used.

An effective amount of succinimide is added in order to stabilize the borated alkyl catechols against hydrolysis. In general, weight percent ratios of succinimide to borated alkyl catechol used to form the complex are in the range of 3:1 to 16:1 and preferably from 3:1 to 10:1 and most preferably 3:1 to 6:1. This latter ratio is preferred if the complex is made and/or stored neat or in the absence of solvent or lubricating oil and under atmospheric conditions.

As used herein, the term "stabilized against hydrolysis" means that the borated alkyl catecholsuccinimide complex does not form a precipitate due to the hydrolysis of the borated catechol for a period of at least three months when stored at room temperature (~15°–25° C.) and ambient humidity.

The amount of the complex required to be effective for reducing friction in lubricating oil compositions may range from 0.5% to 20% by weight percent. However, in the preferred embodiment, it is desirable to add sufficient complex so that the amount of borated catechol is added at a range from 0.1% to about 4% by weight of the total lubricant composition and preferably is present in the range of from 0.2% to 2% by weight and most preferably 0.5% to 1%. The succinimide is present in the complex of the invention in an amount effective to stabilize the borated alkyl catechol against hydrolysis and which allows the borated alkyl catechol to function as effective friction reducing agents.

Also, the succinimide in the complex acts as a dispersant and prevents the deposition of contaminants formed in the oil during operation of the engine.

In general, the complexes of this invention may also be used in combination with other additive systems in conventional amounts for their known purpose.

For example, for application in modern crankcase lubricants, the base composition described above will be formulated with supplementary additives to provide the necessary stability, detergency, dispersancy, anti-wear and anti-corrosion properties.

Thus, as another embodiment of this invention, the lubricating oils to which the complexes prepared by reacting the borated alkyl catechols and succinimides may contain an alkali or alkaline earth metal hydrocarbyl sulfonate, an alkali or alkaline earth metal phenate, and Group II metal salt dihydrocarbyl dithiophosphate.

Also, since the succinimides act as excellent dispersants, additional succinimide may be added to the lubricating oil compositions, above the amounts added in the form of the complex with the borated alkyl catechols. The amount of succinimides can range up to about 20% by weight of the total lubricating oil compositions.

The alkali or alkaline earth metal hydrocarbyl sulfonates may be either petroleum sulfonate, synthetically alkylated aromatic sulfonates, or aliphatic sulfonates such as those derived from polyisobutylene. One of the more important functions of the sulfonates is to act as a detergent and dispersant. These sulfonates are well known in the art. The hydrocarbyl group must have a sufficient number of carbon atoms to render the sulfonate molecule oil soluble. Preferably, the hydrocarbyl portion has at least 20 carbon atoms and may be aromatic or aliphatic, but is usually alkylaromatic. Most preferred for use are calcium, magnesium or barium sulfonates which are aromatic in character.

Certain sulfonates are typically prepared by sulfonating a petroleum fraction having aromatic groups, usually mono- or dialkylbenzene groups, and then forming the metal salt of the sulfonic acid material. Other feedstocks used for preparing these sulfonates include synthetically alkylated benzenes and aliphatic hydrocarbons prepared by polymerizing a mono- or diolefin, for example, a polyisobutenyl group prepared by polymerizing isobutene. The metallic salts are formed directly or by metathesis using well-known procedures.

The sulfonates may be neutral or overbased having base numbers up to about 400 or more. Carbon dioxide and calcium hydroxide or oxide are the most commonly used material to produce the basic or overbased sulfonates. Mixtures of neutral and overbased sulfonates may be used. The sulfonates are ordinarily used so as to provide from 0.3% to 10% by weight of the total composition. Preferably, the neutral sulfonates are present from 0.4% to 5% by weight of the total composition and the overbased sulfonates are present from 0.3% to 3% by weight of the total composition.

The phenates for use in this invention are those conventional products which are the alkali or alkaline earth metal salts of alkylated phenols. One of the functions of the phenates is to act as a detergent and dispersant. Among other things, it prevents the deposit of contaminants formed during high temperature operation of the engine. The phenols may be mono- or polyalkylated.

The alkyl portion of the alkyl phenate is present to lend oil solubility to the phenate. The alkyl portion can be obtained from naturally occurring or synthetic sources. Naturally occurring sources include petroleum hydrocarbons such as white oil and wax. Being derived from petroleum, the hydrocarbon moiety is a mixture of different hydrocarbyl groups, the specific composition of which depends upon the particular oil stock which was used as a starting material. Suitable synthetic sources include various commercially available alkenes and alkane derivatives which, when reacted with the phenol, yield an alkylphenol. Suitable radicals obtained include butyl, hexyl, octyl, decyl, dodecyl, hexadecyl, eicosyl, triacontyl, and the like. Other suitable synthetic sources of the alkyl radical include olefin polymers such as polypropylene, polybutylene, polyisobutylene and the like.

The alkyl group can be straight-chained or branch-chained, saturated or unsaturated (if unsaturated, preferably containing not more than 2 and generally not more than 1 site of olefinic unsaturation). The alkyl radicals will generally contain from 4 to 30 carbon atoms. Generally when the phenol is monoalkyl-substituted, the alkyl radical should contain at least 8 carbon atoms. The phenate may be sulfurized if desired. It may be either neutral or overbased and if overbased will have a base number of up to 200 to 300 or more. Mixtures of neutral and overbased phenates may be used.

The phenates are ordinarily present in the oil to provide from 0.2% to 27% by weight of the total composition. Preferably, the neutral phenates are present from 0.2% to 9% by weight of the total composition and the overbased phenates are present from 0.2 to 13% by weight of the total composition. Most preferably, the overbased phenates are present from 0.2% to 5% by weight of the total composition. Preferred metals are calcium, magnesium, strontium or barium.

The sulfurized alkaline earth metal alkyl phenates are preferred. These salts are obtained by a variety of processes such as treating the neutralization product of an alkaline earth metal base and an alkylphenol with sulfur. Conveniently the sulfur, in elemental form, is added to the neutralization product and reacted at elevated temperatures to produce the sulfurized alkaline earth metal alkyl phenate.

If more alkaline earth metal base were added during the neutralization reaction than was necessary to neutralize the phenol, a basic sulfurized alkaline earth metal alkyl phenate is obtained. See, for example, the process of Walker et al, U.S. Pat. No. 2,680,096. Additional basicity can be obtained by adding carbon dioxide to the basic sulfurized alkaline earth metal alkyl phenate. The excess alkaline earth metal base can be added subsequent to the sulfurization step but is conveniently added at the same time as the alkaline earth metal base is added to neutralize the phenol.

Carbon dioxide and calcium hydroxide or oxide are the most commonly used material to produce the basic or "overbased" phenates. A process wherein basic sulfurized alkaline earth metal alkylphenates are produced by adding carbon dioxide is shown in Hanneman, U.S. Pat. No. 3,178,368.

The Group II metal salts of dihydrocarbyl dithiophosphoric acids exhibit wear, antioxidant and thermal stability properties. Group II metal salts of phosphorodithioic acids have been described previously. See, for example, U.S. Pat. No. 3,390,080, columns 6 and 7, wherein these compounds and their preparation are described generally. Suitably, the Group II metal salts of the dihydrocarbyl dithiophosphoric acids useful in the lubricating oil composition of this invention contain from about 4 to about 12 carbon atoms in each of the hydrocarbyl radicals and may be the same or different and may be aromatic, alkyl or cycloalkyl. Preferred hydrocarbyl groups are alkyl groups containing from 4 to 8 carbon atoms and are represented by butyl, isobutyl, sec.-butyl, hexyl, isohexyl, octyl, 2-ethylhexyl and the like. The metals suitable for forming these salts include barium, calcium, strontium, zinc and cadmium, of which zinc is preferred.

Preferably, the Group II metal salt of a dihydrocarbyl dithiophosphoric acid has the following formula:

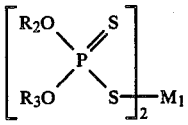

wherein:

e. $R_2$ and $R_3$ each independently represent hydrocarbyl radicals as described above, and f. $M_1$ represents a Group II metal cation as described above.

The dithiophosphoric salt is present in the lubricating oil compositions of this invention in an amount effective to inhibit wear and oxidation of the lubricating oil. The amount ranges from about 0.1 to about 4 percent by weight of the total composition, preferably the salt is present in an amount ranging from about 0.2 to about 2.5 percent by weight of the total lubricating oil composition. The final lubricating oil composition will ordinarily contain 0.025 to 0.25% by weight phosphorus and preferably 0.05 to 0.15% by weight.

The finished lubricating oil may be single or multigrade. Multigrade lubricating oils are prepared by adding viscosity index (VI) improvers. Typical viscosity index improvers are polyalkyl methacrylates, ethylene propylene copolymers, styrene diene copolymers and the like. So-called decorated VI improvers having both viscosity index and dispersant properties are also suitable for use in the formulations of this invention.

The lubricating oil used in the compositions of this invention may be mineral oil or in synthetic oils of lubricating viscosity and preferably suitable for use in the crankcase of an internal combustion engine. Crankcase lubricating oils ordinarily have a viscosity of about 1300 cst 0° F. to 22.7 cst at 210° F. (99° C.). The lubricating oils may be derived from synthetic or natural sources. Mineral oil for use as the base oil in this invention includes paraffinic, naphthenic and other oils that are ordinarily used in lubricating oil compositions. Synthetic oils include both hydrocarbon synthetic oils and synthetic esters. Useful synthetic hydrocarbon oils include liquid polymers of alpha olefins having the proper viscosity. Especially useful are the hydrogenated liquid oligomers of $C_{6-12}$ alpha olefins such as 1-decene trimer. Likewise, alkyl benzenes of proper viscosity such as didodecyl benzene, can be used. Useful synthetic esters include the esters of both monocarboxylic acid and polycarboxylic acids as well as monohydroxy alkanols and polyols. Typical examples are didodecyl adipate, pentaerythritol tetracaproate, di-2-ethylhexyl adipate, dilaurylsebacate and the like. Complex esters prepared from mixtures of mono and dicarboxylic acid and mono and dihydroxy alkanols can also be used.

Blends of hydrocarbon oils with synthetic oils are also useful. For example, blends of 10 to 25 weight percent hydrogenated 1-decene trimer with 75 to 90 weight percent 150 SUS (100° F.) mineral oil gives an excellent lubricating oil base.

Additive concentrates are also included within the scope of this invention. They usually include from about 90 to 20 weight percent of an oil of lubricating viscosity and from about 20 to 90 weight percent of the complex additive of this invention. Typically, the concentrates contain sufficient diluent to make them easy to handle during shipping and storage. Suitable diluents for the concentrates include any inert diluent, preferably an oil of lubricating viscosity, so that the concentrate may be readily mixed with lubricating oils to prepare lubricating oil compositions. Suitable lubricating oils which can be used as diluents typically have viscosities in the range from about 35 to about 500 Saybolt Universal Seconds (SUS) at 100° F. (38° C.), although an oil of lubricating viscosity may be used.

Other additives which may be present in the formulation include rust inhibitors, foam inhibitors, corrosion inhibitors, metal deactivators, pour point depressants, antioxidants, and a variety of other well-known additives.

The following examples are offered to specifically illustrate the invention. These examples and illustrations are not to be construed in any way as limiting the scope of the invention.

EXAMPLES

Example 1

Preparation of $C_{14}$–$C_{18}$ Alkyl Catechol

To a 3-liter flask, equipped with stirrer, Dean Stark trap, condensor and nitrogen inlet and outlet was charged 759 gm. of a $C_{14}$–$C_{18}$ alpha-olefin (2% $C_{14}$; 30% $C_{15}$; 30% $C_{16}$; 28% $C_{17}$; and 10% $C_{18}$), 330 gms. of pyrocatechol, 165 gms. of a sulfonic acid cation exchange resin (polystyrene cross-linked with divinylbenzene) catalyst (Amberlyst 15 supplied by Rohm and Haas) and 240 mls. toluene. The reaction mixture was heated at 150° C. to 160° C. for about 7 hours with stirring under a nitrogen atmosphere. The reaction mixture was stripped by heating to 160° C. under vacuum (0.4 mm Hg). The product was filtered hot over super cell (SCC) to afford 908.5 gms. of $C_{14}$–$C_{18}$ alkyl substituted pyrocatechol. The product had a hydroxyl number of 259. In a similar manner, by substituting an equivalent amount of each of a $C_{12}$ alpha-olefin, a $C_{14}$ alpha-olefin and a $C_{18}$ alpha-olefin in the above procedure, the corresponding alkyl catechols are prepared.

Example 2

Preparation of $C_{16}$–$C_{26}$ Alkyl Catechol

To a 3-liter flask, equipped with stirrer, Dean Stark trap, condensor and nitrogen inlet and outlet was added 759 gms. of a mixture of $C_{16}$ to $C_{26}$ olefin (less than $C_{14}$—2.7%; $C_{14}$—0.3%; $C_{16}$—1.3%; $C_{18}$—8.0%; $C_{20}$—44.4%; $C_{22}$—29.3%; $C_{24}$—11.2%; $C_{26}$—2.2%; $C_{28}$—0.4%; $C_{30}$—0.2%) (containing at least 40% branching (available from Ethyl Corp.), 330 gms. of pyrocatechol, 165 gms. of a sulfonic acid cation exchange resin (polystyrene crosslinked with divinylbenzene) catalyst (Amberlyst 15 ®) available from Rohm and Haas, Philadelphia, Pa.) and 240 ml. toluene. The reaction mixture was heated to 150° C. to 160° C. for about 7 hours with stirring under a nitrogen atmosphere. The reaction mixture was stripped by heating to 160° C. under vacuum (0.4 mm Hg). The product was filtered hot over diatomaceous earth to afford 971 gms. of a liquid $C_{16}$ to $C_{26}$ alkyl-substituted pyrocatechol.

Example 3

Preparation of Borated $C_{14}$–$C_{18}$ Alkyl Catechol

To a 906 grams of $C_{14}$–$C_{18}$ alkyl catechol was added 124 grams boric acid and 900 ml of toluene. The reaction mixture was heated at 105 to 118° C. for about 6 hours under a nitrogen atmosphere at azeotropic conditions. 93 mls of water were collected by a Dean Stark trap. The reaction product was filtered and stripped on a roto evaporator under vacuum to 155° C. to yield 930 grams of the title product.

Example 4

An oil blend was prepared as indicated in Table I using CitCon 100N oil and containing 1.0% by weight of the borated alkyl catechol prepared according to Example 3.

TABLE I

| Formulation | Time - Days | Observation |
|---|---|---|
| Base oil | 1–3 | bright and clear |
| Base oil + 1% by weight Borated Alkyl Catechol of Example 3 | 1 | hazy and precipitate formed |

Example 5

One part by weight of the borated alkyl catechol prepared according to Example 3 and 3 parts by weight of a 48% by weight of polyisobutenyl succinimide (prepared by reacting polyisobutenyl succinic anhydride wherein the number average molecular weight of the polyisobutenyl was about 950 and tetraethylenepentamine in a mole ratio of amine to anhydride of 0.87) solution in oil (CitCon 100N) were heated together with mixing on a hot plate at 100° C. for 0.5 hours.

20 ml of the reaction mixture was placed in a 100 ml beaker and stored. A 100 ml beaker containing 20 ml of only the borated alkyl catechol which had been heated up to 150° C. and no succinimide was also stored for a comparison.

The borated alkyl catechol hydrolyzed and formed a skin on its surface as it cooled down (approx. 1/4-hr). The borated alkyl catechol-succinimide complexed material remained bright and clear after one week in storage. Even after three weeks, the sample remained clear.

What is claimed is:

1. A composition comprising a complex prepared by reacting a borated alkyl catechol and an oil soluble alkyl or alkenyl succinimide wherein the weight precent ratio of the alkyl or alkenyl succinimide to the borated alkyl catechol ranges from 3:1 to 16:1.

2. The composition according to claim 1 wherein the alkyl group of said borated alkyl catechol contains from 10 to 30 carbon atoms and said succinimide is a polyisobutenyl succinimide of a polyalkylene polyamine.

3. The composition according to claim 2 wherein said succinimide is a polyisobutenyl succinimide of triethylenetetramine or polyisobutenyl succinimide of tetraethylenepentamine.

4. The composition according to claim 2 wherein said alkyl group of said borated alkyl catechol is a mixture of alkyl groups containing 16–26 carbon atoms.

5. The composition according to claim 2 wherein said alkyl groups of said borated alkyl catechol is a mixture of alkyl groups containing 14 to 18 carbon atoms.

6. A lubricating oil composition comprising a major amount of an oil of lubricating viscosity and an effective amount to reduce friction of a complex prepared by reacting a borated alkyl catechol and an oil soluble alkyl or alkenyl succinimide wherein the weight percent ratio of the alkyl or alkenyl succinimide to the borated alkyl catechol ranges from 3:1 to 16:1.

7. The lubricating oil composition according to claim 6 wherein the alkyl group of said borated alkyl catechol is a mixture of $C_{16}$-$C_{26}$ alkyl groups and said succinimide is a polyisobutenyl succinimide of a polyalkylene polyamine.

8. The lubricating oil composition according to claim 6 wherein the alkyl group of said borated alkyl catechol is a mixture of $C_{14}$-$C_{18}$ alkyl groups.

9. The lubricating oil composition according to claim 7 wherein said succinimide is a polyisobutenyl succinimide of triethylenetetramine or polyisobutenyl succinimide of tetraethylenepentamine.

10. A method for reducing the fuel consumption of an internal combustion engine comprising treating the moving surfaces thereof with a composition according to claim 6.

* * * * *